United States Patent [19]

Hudson, III

[11] 4,315,458

[45] Feb. 16, 1982

[54] VENTILATED WIND-DIVERTER SHED FOR MAN-SPRAYING OF POLYURETHANE FOAM FROM WITHIN ONTO ROOFS

[76] Inventor: Raymond M. Hudson, III, P.O. Box 443, Bernardsville, N.J. 07924

[21] Appl. No.: 211,706

[22] Filed: Dec. 1, 1980

[51] Int. Cl.[3] ..... B05C 15/00

[52] U.S. Cl. ..... 98/115 VM; 55/385 R; 55/385 C; 98/115 R; 118/326; 118/DIG. 7

[58] Field of Search ..... 98/29, 115 R, 115 SB, 98/115 VM; 118/326, 504, DIG. 7, 634; 55/385 R, 385 C

[56] References Cited

U.S. PATENT DOCUMENTS

| | | | |
|---|---|---|---|
| 642,166 | 1/1900 | Sherman | 98/115 R |
| 1,460,098 | 6/1923 | Houser | 52/82 |
| 2,175,259 | 10/1939 | Erickson | 118/326 X |
| 2,424,202 | 7/1947 | Woolery | 118/305 |
| 2,761,373 | 9/1956 | Owen | 98/115 VM |
| 2,810,336 | 10/1957 | Sheffer et al. | 98/115 SB |
| 2,842,093 | 7/1958 | O'Neill | 118/504 X |
| 3,434,416 | 3/1969 | Testone | 118/326 X |
| 3,820,627 | 6/1974 | Wirt | 98/115 R X |
| 3,861,594 | 1/1975 | Wendling | 118/326 X |
| 4,199,896 | 4/1980 | Lehman | 47/1.7 |

*Primary Examiner*—Larry I. Schwartz
*Assistant Examiner*—Harold Joyce

[57] ABSTRACT

In a preferred embodiment, a motorized shed travels on a rail on two wheels thereof along a surface such as a roof while being adapted for spraying polyurethane foam from within a wind-diverter shed by a manual operator within, downwardly through a bottom port, and ventilation being through an upper open port having screen thereacross of a small mesh size which captures small droplets of polyurethane that might otherwise escape into exterior air and wind, from space within the shed. The walls of the shed are at an angle of preferably and typically about 55 degrees from a horizontal inclined inwardly as from a longer and wider base to a narrower top portion, and the shed has left and right sides of rectangular shape extending about $4\frac{1}{4}$ feet in length, a periphery along a lower edge of the shed being about 45 feet, and the shed has a height of preferably about $3\frac{1}{2}$ feet apart from the screen structure which may further increase the overall outer and inner height.

12 Claims, 16 Drawing Figures

VENTILATED WIND-DIVERTER SHED FOR MAN-SPRAYING OF POLYURETHANE FOAM FROM WITHIN ONTO ROOFS

This invention is directed to a novel spraying shed of a type housing a manual operator conducting the spraying from within the shed downwardly onto a surface such as a roof.

BACKGROUND TO THE INVENTION

Prior to the present invention, there have existed numerous problems in the business of spraying surfaces, particularly rooves, with polyurethane foam, because of the aerosol nature of fine droplets of the spray which travel on the winds great distances, and become deposited on all sorts of objects in the path of the wind, such as on the tops of automobiles and their windshields, and various other objects, as well as onto people in the vicinity. Because of the great tendency of the polyurethane foam droplets to travel and to cause extensive damage noted-above, the conducting of the spraying of rooves has been severly restricted to periods of time when there are a minimum number of persons and objects around that could be harmed or depreciated by deposit of polyurethane foam thereon, and times when the wind factor is very low in velocity. Accordingly, the available periods during which work may be conducted for the spraying of rooves with polyurethane foam has been severly restricted and thereby has caused great economic hardship on persons in this type of business. As a result of the polyurethane foam spraying being limited to periods when there is no substantial breeze or wind and to periods when there are no substantial numbers of automobiles, people and the like around to become subject to damage, the cost for performing the spraying business has been driven upwardly because of the limited amount of times available for safely doing such jobs. Likewise, there has been a major restriction of income that might be brought in as compensation or salary to the sprayer personnel, because of the limited number of jobs that can be performed per week and per month.

Additionally, there have existed problems in efforts to shield wind, because very often the use of a shield results in causing greater wind or air tubulence, as well as it not being normally easy nor practical to move along a shield while spraying, and as well as normally there being a problem of lack of proper ventilation resulting in potential health hazard to the spraying manual personnel.

Another problem associated with efforts to utilize shields, has been the need of a shield against wind, of large size in order to be appropriately effective, but large shield sizes have been accompanied with problems of the force of the wind serving to blow over—possibly onto spraying personnel, or to lift-up the shield and generally to cause more havoc than can be tolerated in a commercial operation that should be effective, efficient and speedy and safe.

A part of the problem accompanying the spraying of roofs with polyurethane foam, is the need of the sprayer (the manual operator) to have a clear view of the surface being sprayed at the moment that the spraying is taking place, i.e. an unobstructed view, in order to have full appreciation and knowledge of the nature and extent of adequate or inadequate spraying of the roof surface. Accordingly, it is important that the wind shield not block the view of the operator, and accordingly that the shield be one which does not become an obstacle between the area being sprayed and the operator. Thus it is important that the sprayer apparatus not be in a separate enclosure from the spraying personnel applying the spray of polyurethane foam.

The filing of the patent application is done solely after a novelty search was conducted, but which search failed to discover any prior patents or other disclosures relating to the present invention's spraying of polyurethane foam from within an enclosure or any other patents relating to the spraying of polyurethane foam while making use of a wind-diverter shield or shed. Sole patents located, believed to be totally non-analagous and directed to unrelated other subject matters not making obvious the present invention relative to the problems to which the present invention is directed, are as follow. The Woolery U.S. Pat. No. 2,424,202 discloses a small enclosure having an open top and an open bottom into which spray is sprayed through the channel thereof thereby formed, onto railroad ties, in use in the treating of railroad ties. In being associated with the treating of railroad ties, the spraying apparatus is carried on a roller that rolls along a rail of the railroad. Another patent is the Lehman U.S. Pat. No. 4,199,896 which discloses a boom-spayer assembly for the spraying of herbicides in a controlled pattern, onto trees, bushes and the like, out from a vehicle or other apparatus from which the liquid is conducted to the sprayer nozzle; the spray is sprayed from the top of a conical closed-top enclosure outwardly downwardly through a bottom open port. Another totally nonanalagous patent is the Houser U.S. Pat. No. 1,460,098 which is merely directed to a portable knock-down shelter, but which has nothing to do with spraying, muchless with the spraying of polyurethan foam onto a roof surface and the problems associated with such an operation.

SUMMARY OF THE INVENTION

A major object of the present invention is to obtain a ventilated wind-diverter shed which overcomes problems and difficulties and disadvantages of the types described above, and which is of a size suitable for manned operation of polyurethane foam spraying from within shed space.

Another object is to obtain a polyurethane foam sprayer shed having a predetermined shape suited for withstanding high velocity winds and breezes.

Another object is to obtain a polyurethane foam sprayer wind-diverter shed which effectively controls and restricts the exterior fogging and interior escape of fine droplets of polyurethane foam spray droplets from spraying space within the shed.

Another object is to obtain a polyurethane foam sprayer wind-diverter shed suitable for travel conveniently and easily along the surface being sprayed during the spraying operation.

Another object is to obtain a motorized polyurethan foam sprayer wind-diverter shed and wind-shield.

Another object is to obtain a ventilated wind-diverter polyurethane foam sprayer shed having controlled direction of movement during the spraying operation.

Another object is to obtain a polyurethane foam sprayer wind-diverter shed having sufficient space within and ventilation sufficient to reduce hazards associated with health of the manual operator within shed space.

Another object is to obtain a polyurethan foam sprayer wind-diverter shed with appropriate ventilation, of a structure and design sufficiently simple and inexpensive and efficient, to be economically feasible.

Other objects become apparent from the preceding and following disclosure.

One or more objects of the invention are obtained by the invention as described herein, and as illustrated in the accompanying drawings which are representative of preferred embodiments and are not intended to limit the scope of the invention but to merely improve understanding of the heart of the invention but not eliminating other various variations and embodiment intended to be obviously included within the spirit of the invention.

Broadly the invention may be described as a ventilated wind-diverter shed adapted for spraying polyurethane foam from space within by a manual human being operator, which shed is a structure of circumscribing walls having open bottom and top ports. The circumscribing walls are substantially upright with the shed being normally broader at the bottom than at the top, with the substantially upright side and front and rearward walls being enclined inwardly and upwardly at an angle ranging broadly from about 40 degrees to about 70 degrees, as measured from a base horizontal. The top open port includes a screen mechanism such as a screen mounted thereacross onto top edges of the upright walls, to provide both ventilation making air available to the operator within the enclosed shed space, and concurrently serving to restrict polyurethane foam spray fine droplets from escape from the enclosure space to an exterior of the shed except through the bottom port onto the surface being sprayed. It should be apparent that the shed has dimensions appropriately large to house an upright man during a spraying operation while he sprays polyurethane foam from within the space downwardly out of the shed's bottom port onto a roof surface being sprayed. Also the shed includes appropriate travel mechanism whereby the shed may easily be moved conveniently along a surface to be sprayed, such as along the upper surface of a roof. Normally the shed would be moved during spraying, or alternately intermittently between spraying operations. In one preferred embodiment, there are included a plurality of wheels, with the wheels positioned along the base of the shed to make possible the rolling of the shed along the upper surface of a roof. In a more preferred embodiment, the mobile shed includes a drive mechanism such as an appropriate motor, and the motor may be mounted on the shed itself, or may be elsewhere with appropriate drive mechanisms causing the shed to move along. For example, it is contemplated that one embodiment may have propulsion by air or pneumatic motors with the motor elsewhere and tubes leading to the shed for driving air turbines which drive the drive shaft or axle on which the wheel(s) are mounted. In another preferred embodiment, it has been found that most effective in resisting tilting of the shed by high velocity winds, a wind-diverter shed has respective forward, rearward, and right and left walls of the shed, as may be the case of one or more such walls, is inclined at angle(s) ranging from about 50 degrees to about 60 degrees as measured from a base horizontal, this constituting the preferred range of degrees of inclined angle. In a further preferred embodiment, the mechanism for providing travel includes two of the side wheels being adapted for traveling along and following a rail, and including a rail that is intermittently mountable and then portably removable from a roof to be sprayed.

Also preferably there are downwardly-extending flanges or curtains in the nature of flaps, mounted on and extending downwardly from each of the bottom edges of the circumscribing walls of the shed.

It has been found that the preferred shape of the shed is substantially rectangular in a horizontal plane. Also, a preferred shape most resistant to wind pressures in effectively diverting the wind or breeze and in dimenishing the wind-drafts that ordinarily would carry polyurethane foam spray droplets of fine dimensions, is four sided with four side wall inclusive of right and left side walls and front and rearward walls each being of substantially trapazoidal shape.

In the most preferred embodiment of the invention, the right and left side walls each extend in length from forward to rearward directions, about four to four and one-half feet in length, and the periphery or circumscribing wall structure at a lower base thereof ranges from about 40 feet to about 50 feet thereof around the base of the shed, with the sides being of greater length than the width of the shed as measured along horizontal axes. The most preferred height of such walls is about three to four feet, normally the screen mechanism consisting of screen adding additional height to the entire structure. This preferred embodiment also preferably is substantially of cuboid shape.

THE FIGURES

FIGS. 1, 2, and 3 each represent a common most preferred embodiment of the present invention.

Figure 4:
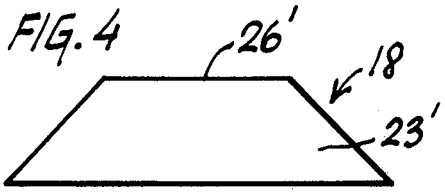
FIGS. 4 through 16 illustrate diagrammatically typical variations, showing other embodiments that typically are within the scope of the invention.
Figure 6:
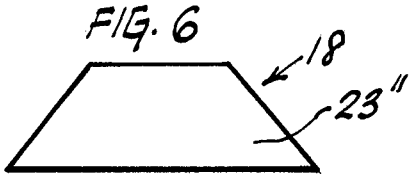
Figure 5:
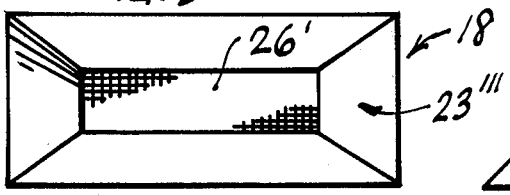

FIGS. 4, 5 and 6 each diagrammatically illustrate a common alternate embodiment.

FIG. 4 illustrates a side view of that embodiment and FIG. 5 illustrates a top or elevation of the FIG. 4 embodiment, and FIG. 6 illustrates a view of the forward side (front) upright wall, the forward upright wall being the same as the rearward upright wall, in appearance and dimensions.

Figure 7:
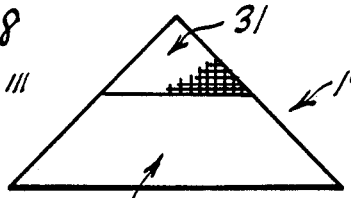
Figure 8:
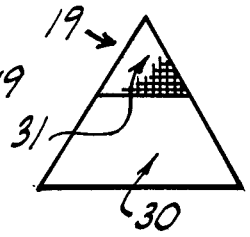

FIGS. 7 and 8 diagrammatically illustrate another alternate embodiment in which each of the left and right side walls are trapezoidal in shape and the screen is triangular in shape, whereby the shed's entire side face for each of the right and left sides is triangular in shape, as shown, the FIG. 7 illustrating solely one wall but each of the right and left walls and faces being identical in shape, appearance and dimensions for this particular embodiment. The FIG. 8 likewise illustrates the forward wall and face of the shed which forward upright wall is trapezoidal and the forward screen face being triangular whereby the shed's entire forward wall or face is in combination a triangular forward appearance. As with FIG. 7, the forward and rearward upright walls and screen faces are identical in appearance and dimensions.

Figure 9:
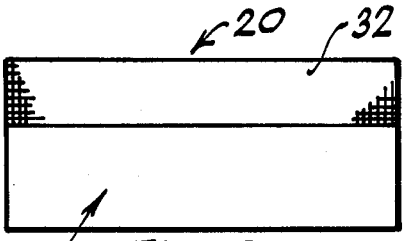
Figure 10:
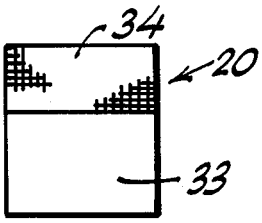

FIGS. 9 and 10 show what might be considered to be a less desired embodiment as being much less effective as a wind diverter, but otherwise being inclusive of inventive concepts of the invention, much less resistant to tipping in high velocity winds. The FIG. 9 is a side view of the embodiment, the right side being viewed, but the left side being identical in shape, appearance and dimensions. FIG. 10 is a side view of the forward upright wall, but the rearward upright wall and screen being identical in shape, appearance and dimensions to the forward upright wall, and screen face.

Figure 11:
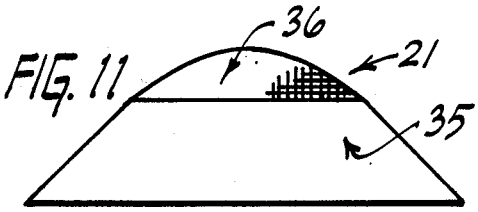
Figure 12:
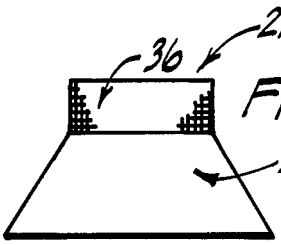
Figure 13:
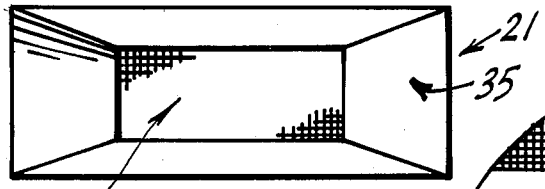

FIGS. 11 through 13 are a common embodiment shown diagrammatically, the FIG. 11 showing a side view of the right side, the FIG. 12 showing a forward side view of the forward upright wall, and the FIG. 13 showing a top view of the embodiment, whereby it can be seen that the right and left walls are mirror images of each other in shape, appearance and dimensions, and likewise for the forward and rearward upright walls and screen faces, noting that the forward screen face and the screen top and the screen rearward face form a continuous from forward to rearward.

Figure 1:
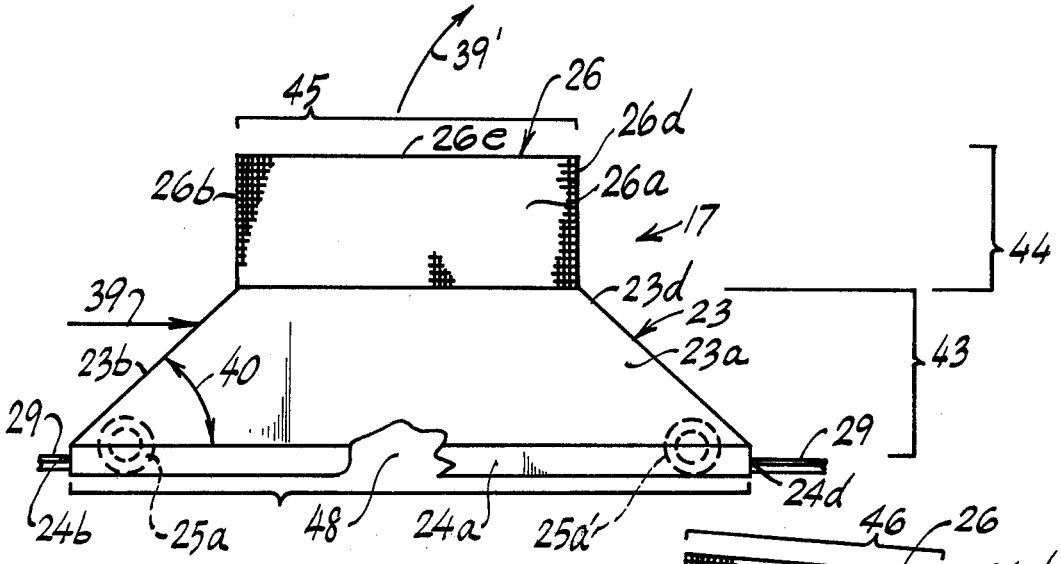
FIG. 1 illustrates in symbolic diagrammatic drawings, typical left-side view of the ventilated wind-diverter shed of the present invention, with partial cut-away, and showing in-part the shed traveling along a rail.
Figure 2:
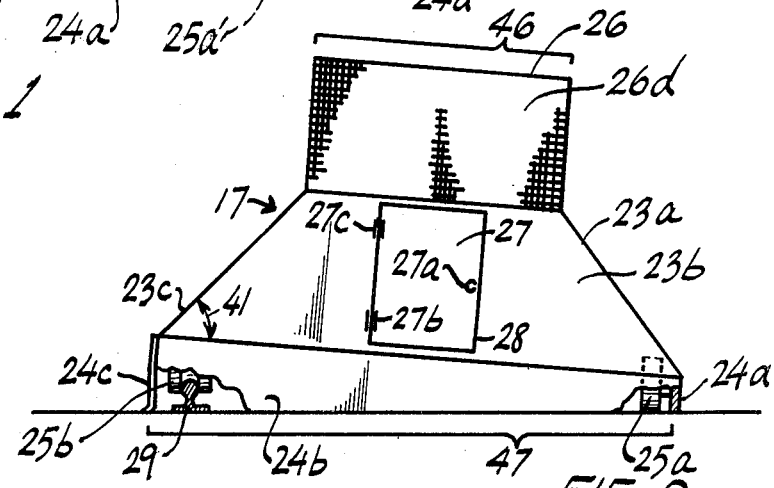
FIG. 2 shows diagrammatically a front view of the embodiment of FIG. 1, with partial cut-away for improved illustration.
Figure 3:
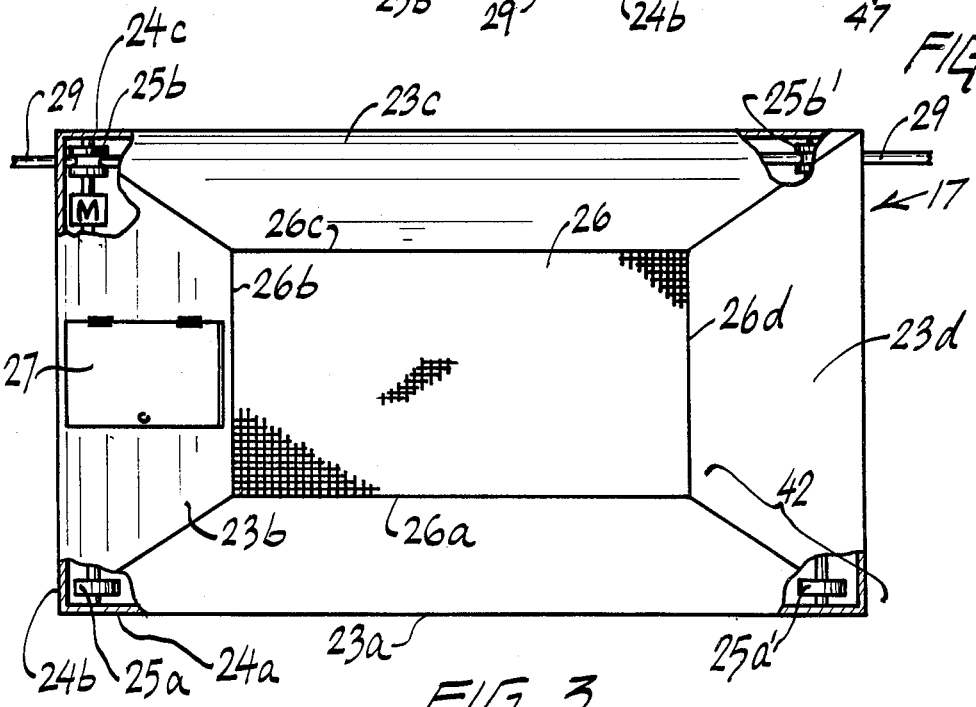
FIG. 3 illustrates diagrammatically a top or elevation view looking downwardly onto the embodiment of FIGS. 1 and 2 with partial cut-away illustration.
Figure 14:
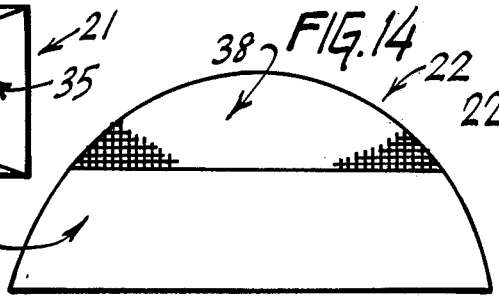
Figure 15:
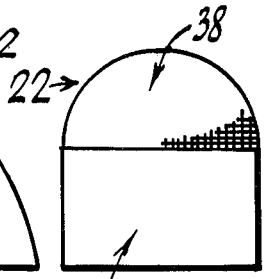
Figure 16:
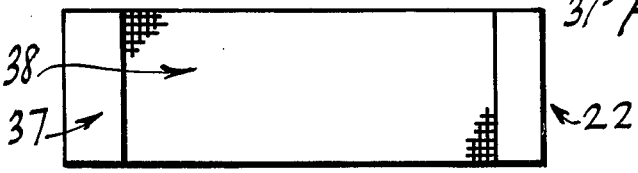

FIGS. 14 through 16 illustrate a common embodiment symbolically, FIG. 1 being of the right side, FIG. 2 of the front side and FIG. 3 being a top view of the shed. Again, the right and left sides are mirror images, and the screen top is arcuate as between opposite sides and also as between front and rearward upright walls.

DETAILED DESCRIPTION

Common preferred embodiment illustrations of FIGS. 1, 2, and 3 utilize corresponding numerals for corresponding elements or parts in the different figures, and accordingly the description will not be repeated for each figure.

FIG. 1 illustrates a ventilated wind-diverter shed 17 in side view, viewing the left side of the shed as facing towards the left with the rear toward the right. It includes the circumscribing walls 23 composed of the left upright wall 23*a*, the forward upright wall 23*b*, the right upright wall not visible in FIG. 1, as right upright wall 23*c*, and the rear or back upright wall 23*d*. The shed has a support carriage on which wheels are mounted, identified in phantom in FIG. 1, for the left forward and rearward wheels 25*a* and 25*a*', and as shown in cutaway of FIGS. 2 and 3 as wheels 25*a*, 25*b* in FIG. 2 and wheels 25*a*, 25*a*', 25*b*, and 25*b*' in FIG. 3. The upper open port of the circumscribing walls 23, has mounted the screen structure 26 across the port, which structure includes the top 26*e*, and which includes the left, forward, right and rearward screen walls 26*a*, 26*b*, 26*c* and 26*d*. The material out of which the circumscribing walls is made, is preferably a light weight material, the entire structure of the shed being of light weight material, making possible the mere lifting of one side or the other in order for the manual operator worker to lift the side to step thereunder into the inner space of the shed; in this preferred embodiment, there is illustrated a door 27 within a jamb 28 having a door knob 27*a* and hinges 27*b* and 27*c*, in the forward upright wall 23*b*. The circumscribing walls 23*a*, 23*b*, 23*c*, and 23*d* preferably are of plexiglass material or other lightweight material such as aluminum or the like. The track 29 is shown in each of FIGS. 1, 2, and 3; for the wheels riding on the track, FIGS. 2 and 3 illustrate the forward wheel 25*b* and 25*b*' riding on the track 29. The wheels 25*a* and 25*a*' roll along the surface to be coated, such as the upper surface of a roof. Suspended from the underside edge of the circumscribing upright walls 23*a*, 23*b*, 23*c*, and 23*d*, are the downwardly-extending flanges or curtains 24*a*, 24*b*, 24*c*, and 24*d* as shown in FIGS. 1, 2, and 3. These flanges are preferably flexible rubber flaps of sufficiently heavy and rigid composition as to not be moved upwardly by gusts of wind but to be bendable responsive to pressure of obstructions, or upon touching high spots on the roof, or the like. These flanges serve to prevent the fogging of the fine spray droplets of polyurethane spray during the spraying operation outwardly beneath the bottom edges of the upright walls. It should be noted that while the invention is directed to a polyurethane foam spraying shed, and this being the heart of the invention in so far as the moving purpose of the invention, nevertheless, the spraying apparatus itself does not constitute a part of the claimed invention, and such spraying apparatus may be of any desired shape or construction or of any conventional design not inconsistant with the stated objects of the invention. Likewise, the spraying apparatus may be portable and entirely separate from the shed, or alternately it may be mounted in full or in part permanently or detachably within the shed, on shed structure. In like manner, a motor is symbolically illustrated in FIG. 3, designated M and may be of any of various types of conventional or desired motors conventionally connected operatively to drive one or more of the wheels of the shed, such as driving a drive shaft and/or axle of one or more of the wheels.

The particular mechanism of attachment of the motor is not a major point in the invention, except that it drive the shed in a preferred embodiment.

The driving mechanism could be pneumatic and could be controlled by a control mechanism located exterior to the shed, such as on the ground beneath the roof.

FIGS. 4, 5 and 6 illustrate the shed embodiment 18 which is substantially the same shape as that of FIGS. 1, 2 and 3 except that the screen extends substantially flatly across the upper open port. Each of its sides—right and left sides are trapezoidal in shape, solely the left side being shown; likewise the forward and rearward walls are trapezoidal in shape, solely the forward wall 23'' being shown in FIG. 6. All walls are visible in FIG. 5 as well as the screen 26'.

FIGS. 7 and 8 illustrate a shed 19 which is substantially identicak to that of sheds 17 and 18, having trapezoidal right and left sides and trapezoidal front and rear upright walls, but being different in that the screen has triangular right and left and forward and rearward inclined upright walls coming to a point as a pyrimid as screen structure 31 mounted on circumscribing walls 30. FIG. 7 illustrates the left upright wall and left screen wall, and the right wall is identical in appearance and dimensions although not illustrated; likewise, FIG. 8 illustrates the forward upright wall and screen, and the rearward wall and screen are identical in appearance and dimensions although not illustrated.

FIGS. 9 and 10 illustrate a shed 20 in which the circumscribing walls and top-mounted screen structure are both of cuboid shape, of greater length than width and so thus rectangular. The shed 20 thus has left side 31 of rectangular shape, and likewise for the right side not illustrated; likewise, the forward upright wall 33 is rectangular, and likewise the rearward upright wall that is not illustrated, and showing forward screen wall 34, the rearward screen wall being the same but not illustrated.

FIGS. 11 and 12 illustrate a shed substantially similar to sheds 17, 18, and 19 in-so-far-as the circumscribing walls of left and right walls and forward and rearward upright walls, but the shed 21 having a screen structure 36 with perpendicular upright left and right side screen walls, but with an arcuate screen continuous forward screen wall, top wall and rearward screen wall as shown in both FIGS. 11 and 13.

FIGS. 14, 15 and 16 illustrate the shed 22 with upright left and right side walls of circumscribing walls 37, but with arcuate forward and rearward upright walls and screen walls for the shed as shown in FIG. 14; the screen side walls are also perpendicular as are the sheds side upright walls. The continuous arcuate shape can also be seen in the top view of FIG. 16.

There various embodiments have been illustrated merely to represent some of various possible differing shapes considered to be within the scope of the present invention, but not limited to merely those illustrated, so long as the primary critical factors as described above and as hereinafter claimed.

Accordingly, the use of the wind-diverter shed has in the more preferred embodiment the rail mounted on top of the roof as a temporary mounting on which the rail following wheels are placed. A man enters the shed and sprays polyurethane spray downwardly through the bottom port opening of the shed, onto a roof surface to be coated, including during often windy conditions which would be impossible devoid the shed. When the shed travels to the end of the roof or end of the rail, the rail is then repositioned, and again the shed placed thereon, or other rail and curved end-rails may be used for turning-around or changing direction.

In the most preferred embodiment of FIGS. 1, 2 and 3, the dimensions are additionally preferably as follow. Dimensions along adjoining upright ends of the forward and rearward walls of the circumscribing walls (not inclusive of the screen) are each about four feet to four and one-half feet in length; a lower edge of the circumscribing walls ranges from about forty feet to about fifty feet. The screen has an inside height ranging from about three to four feet, as measured from a top of the upright circumscribing walls.

It should be noted that a human being operator working within the inner space of the shed will wear a protective breathing mask and appropriate protective goggles and other desired protective clothing, to protect the skin and other body parts against the fogging droplets of the polyurethan foam spray.

It is within the scope of the invention to make substitution of equivalents and modifications obvious to a person skilled in this art.

I claim:

1. A ventilated wind-diverter shed comprising in combination: an enclosure structure consisting essentially of a circumscribing wall structure having a bottom open port, said circumscribing wall structure being substantially upright at an upwardly and inwardly-inclined angle ranging from about 40 degrees to about 70 degrees from a horizontal, and said circumscribing wall having a top open port; a screen means mounted across said top open port, said screen means being for providing air ventilation to space shaped by said circumscribing wall structure from exterior air and for limiting polyurethane spray droplets-escape during spraying downwardly through said bottom open port from within the space; said circumscribing wall structure having dimensions along a horizontal and along height sufficiently large such that said space is large enough to house an upright man and spraying equipment; and travel means mounted onto said circumscribing wall structure along substantially a horizontal during spraying of polyurethane downwardly through said bottom open port.

2. A ventilated wind-diverter shed of claim 1, in which said travel means includes a plurality of wheels positioned to travel along a supporting surface while supporting said circumscribing wall structure.

3. A ventilated wind-diverter shed of claim 2, including a drive means mounted on said circumscribing wall structure, for propelling the circumscribing wall structure along a supporting surface.

4. A ventilated wind-diverter shed of claim 3, in which said inwardly-inclined angle ranges from about 50 degrees to about 60 degrees.

5. A ventilated wind-diverter shed of claim 4, including a track means for coordinated functioning with said travel means, for guiding said travel means in a predetermined direction along a supporting surface during polyurethane spraying downwardly through said bottom open port.

6. A ventilated wind-diverter shed of claim 5, in which said track means comprises a rail adapted to be mounted on a supporting surface and in which at least one of said wheels is shaped to travel along and follow said rail.

7. A ventilated wind-diverter shed of claim 6, including substantially flexible downwardly-extending flanges in the nature of flaps, mounted on a lower edge of and extending downwardly from said circumscribing wall structure sufficiently to substantially block escape of fine droplets of polyurethane spray from said bottom open port during spraying of polyurethane downwardly through said bottom open port.

8. A ventilated wind-diverter shed of claim 7, in which bottom edges of said circumscribing wall structure is shaped substantially rectangularly.

9. A ventilated wind-diverter shed of claim 8, in which said circumscribing wall structure includes at least four side walls inclusive of opposing right and left sides and opposing forward and rearward sides.

10. A ventilated wind-diverter shed of claim 9, in which said four side walls are each of substantially trapezoidal shape with upper and lower edges being substantially parallel to each other.

11. A ventilated wind-diverter shed of claim 10, in which dimensions along adjoining upright ends of said forward and rearward sides with said right and left sides are each about four feet to four and one-half feet in length, and in which said circumscribing wall structure along a lower edge thereof has a circumference of from about forty feet to about fifty feet, said right and left sides each being of greater dimensions than each of said forward and rearward sides, and in which said screen means has an inside height ranging from about three feet to about four feet.

12. A ventilated wind-diverter shed of claim 11, in which said screen means comprises a screen-structure having cuboid shape with screen forward and rear walls and screen right and left walls and a screen top, and open bottom mounted on top of top edges of said circumscribing wall structure.

* * * * *